United States Patent [19]

Rushton

[11] Patent Number: 4,943,318

[45] Date of Patent: Jul. 24, 1990

[54] REMOVAL OF THORIUM FROM RAFFINATE

[75] Inventor: Alan Rushton, Preston, United Kingdom

[73] Assignee: British Nuclear Fuels PLC, Warrington, England

[21] Appl. No.: 458,088

[22] Filed: Dec. 27, 1989

[30] Foreign Application Priority Data

Feb. 27, 1989 [GB] United Kingdom ..... 8904433

[51] Int. Cl.[5] ..... C22B 3/00

[52] U.S. Cl. ..... 423/10

[58] Field of Search ..... 75/97, 121

[56] References Cited

U.S. PATENT DOCUMENTS 3,909,247 9/1975 Paris ..... 75/121

4,265,861 5/1981 Cleary ..... 75/121

FOREIGN PATENT DOCUMENTS 813050 5/1981 South Africa .

1219305 1/1971 United Kingdom .

*Primary Examiner*—Peter D. Rosenberg

*Attorney, Agent, or Firm*—Larson and Taylor

[57] ABSTRACT

Thorium is removed from raffinate effluent by pre-washing with odorless kerosene to remove organic contaminants, followed by solvent extraction counter-currently with tri-n-octylphosphine oxide in odorless kerosene. The loaded solvent from the solvent extraction is back-washed with $K_2CO_3$ solution at about 60° C., and subsequent lime addition precipitates $Th(OH)_4$.

13 Claims, 1 Drawing Sheet

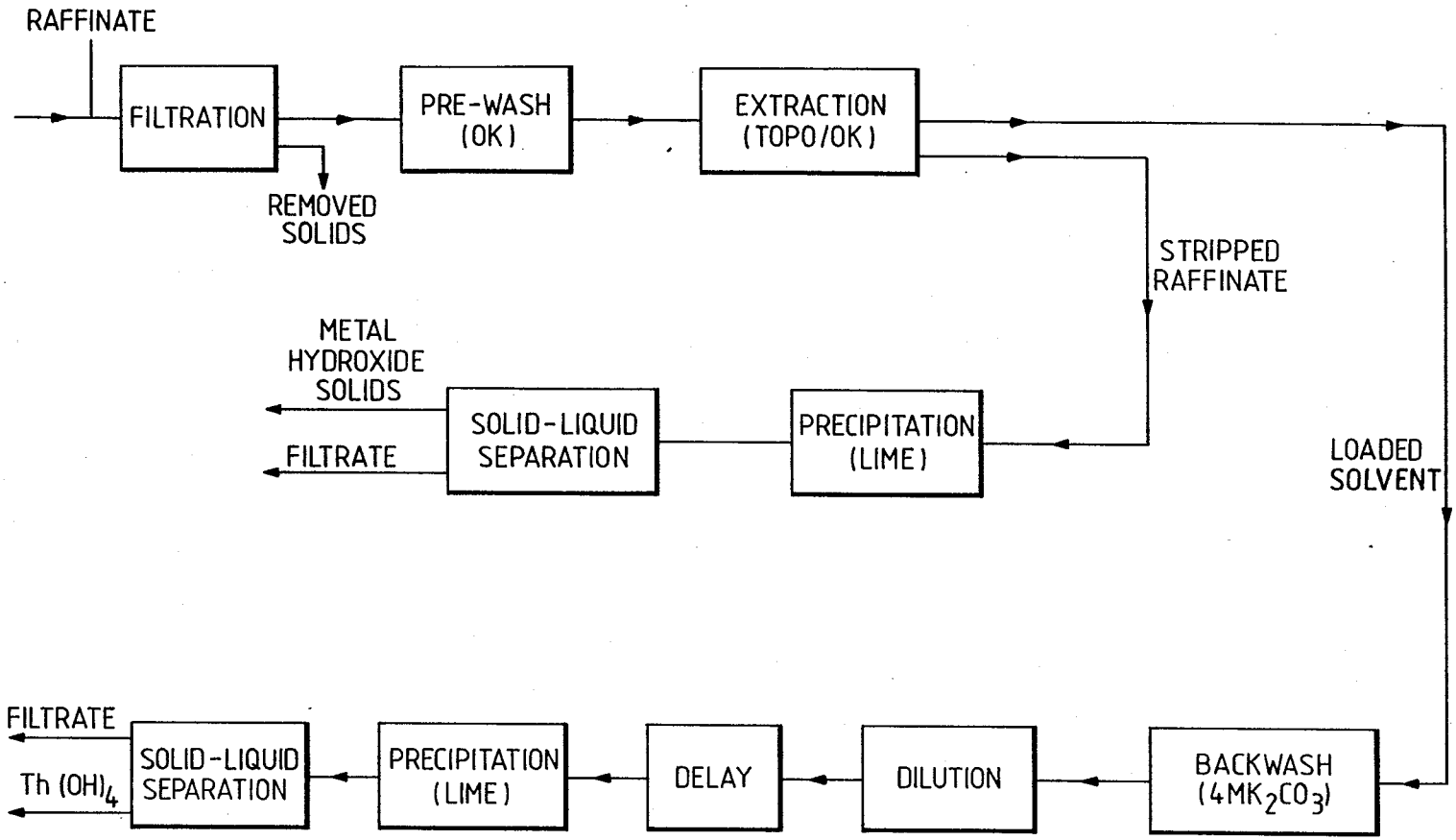
RAFFINATE
FILTRATION
REMOVED SOLIDS
PRE-WASH (OK)
EXTRACTION (TOPO/OK)
STRIPPED RAFFINATE
LOADED SOLVENT
PRECIPITATION (LIME)
SOLID-LIQUID SEPARATION
METAL HYDROXIDE SOLIDS
FILTRATE
BACKWASH ($4MK_2CO_3$)
DILUTION
DELAY
PRECIPITATION (LIME)
SOLID-LIQUID SEPARATION
FILTRATE
$Th(OH)_4$

REMOVAL OF THORIUM FROM RAFFINATE

This invention relates to the removal of thorium from raffinate effluent arising from the processing of uranium ore concentrates. Such raffinate effluent contains radionuclides which contribute $\beta/\delta$ activity, and a significant $\alpha$ activity. Thorium is a major component of this raffinate effluent and it is an object of the invention to provide a process for the removal of thorium from raffinate so that the raffinate may be disposed of more readily.

According to the present invention, there is provided a solvent extraction process for the removal of thorium from raffinate effluent, the process comprising pre-washing the raffinate effluent with odourless kerosene, followed by stripping the pre-washed raffinate effluent by solvent extraction with tri-n-octylphosphine oxide/odourless kerosene solvent, the loaded solvent therefrom then being backwashed with an alkaline solution and the thorium therein precipitated with an alkaline hydroxide slurry.

Preferably, metal hydroxides are precipitated from the stripped raffinate effluent with an alkaline hydroxide slurry.

BRIEF DESCRIPTION OF THE DRAWINGS

The diagram is a flow sheet of the invention.

The invention will now be further described by way of example only with reference to the flow sheet in the accompanying drawing.

Referring to the flow sheet, feed raffinate effluent typically 10–2,000 ppm Th, 5–6MBq/1$\beta$ is passed through a filter stage to remove solids, especially zirconium phosphate. The raffinate filtrate is then passed at ambient temperature counter-currently through a contactor with odourless kerosene (hereinafter referred to as "OK") as a pre-wash to remove organic contaminants, the solvent to aqueous ratio being 1:10. The OK may be recycled until it becomes ineffective. The washed raffinate is then passed counter-currently through a contactor with 0.1 M tri-n-octylphosphine oxide (hereinafter referred to as "TOPO") solvent in OK at nominally a 1:10 solvent to aqueous ratio, subject to a maximum thorium loading in the solvent of 4000 $\mu$g/ml. For raffinates which would result in thorium solvent loadings greater than 4000 $\mu$g/ml, the solvent to aqueous ratio should be varied such that a solvent loading of 4000 $\mu$g/ml is achieved. The loaded solvent is backwashed by passing counter-currently through a contactor at 60° C. with 4M $K_2CO_3$ solution at a 10:1 solvent to aqueous ratio, and subsequently diluted by a 30% w/w water addition to prevent $KNO_3$ crystallisation upon cooling. After a delay to allow $\beta$ activity to reduce, $Th(OH)_4$ is precipitated from the loaded solvent with 10% w/w lime slurry and removed by filtration to leave a relatively inactive filtrate.

The stripped raffinate after solvent-extraction with the TOPO/OK is treated with 10% w/w lime slurry to precipitate metal hydroxides such as iron, magnesium, etc and subsequently filtered to produce relatively inactive solids and filtrate. The solvent recovered from the backwashing stage may be recycled.

In one application of the process, the pre-wash comprised four stages, and the TOPO/OK solvent extraction comprised six stages, although it should be understood that alternative numbers of stages may be used. The stages may comprise mixer-settlers, although other solvent extraction apparatus such as pulse columns may be used. A typical raffinate for treatment by the process of the invention might comprise:

| Component | Mean Value |
|---|---|
| Sodium and Potassium (mg/l) | 1700 |
| Magnesium and Calcium (mg/l) | 1700 |
| Aluminium (mg/l) | 1200 |
| Iron (mg/l) | 1200 |
| Uranium (mg/l) | 10 |
| Thorium (mg/l) | 800 |
| Undissolved Solids (mg/l) | 210 |
| Nitric Acid (M) | 1–2 |
| $\alpha$ Activty (MBq/m3) | 34 |
| $\beta/\gamma$ Activity (GBq/m3) | 5 |
| Flow (m3/hr) | 5 |

I claim:

1. A solvent extraction process for the removal of thorium from raffinate effluent, the process comprising pre-washing the raffinate effluent with odourless kerosene, followed by stripping the pre-washed raffinate effluent by solvent extraction with tri-n-octylphosphine oxide/odourless kerosene solvent, the loaded solvent therefrom then being back-washed with an alkaline solution and the thorium therein precipitated with an alkaline hydroxide slurry.

2. A process as claimed in claim 1, including precipitating metal hydroxides from the stripped raffinate effluent with an alkaline hydroxide slurry.

3. A process as claimed in claim 1, wherein the solvent to aqueous ratio in the prewash is about 1:10.

4. A process as claimed in claim 3, wherein the raffinate effluent in the pre-wash is passed through the contactor at ambient temperature.

5. A process as claimed in claim 1, including arranging the solvent to aqueous ratio in said solvent extraction to provide that the maximum thorium loading in the solvent does not exceed 4000 $\mu$g/ml.

6. A process as claimed in claim 5, wherein the tri-n-octylphosphine oxide in said solvent extraction is about 0.1M concentration.

7. A process as claimed in claim 6, wherein the solvent to aqueous ratio in said solvent extraction is about 1:10.

8. A process as claimed in claim 6, wherein the alkaline solution comprises $K_2CO_3$, and the solvent to aqueous ratio is about 10:1.

9. A process as claimed in claim 8, wherein the $K_2CO_3$ is about 4M concentration, and the stripping is performed at a temperature of about 60° C.

10. A process as claimed in claim 9, including subsequently diluting with water the stripped loaded solvent to inhibit $KNO_3$ crystallisation upon cooling.

11. A process as claimed in claim 10, wherein the alkaline hydroxide slurry to precipitate the thorium and/or the metal hydroxides comprises a lime slurry of about 10% w/w.

12. A process as claimed in claim 11, including filtering the raffinate effluent before pre-washing thereof to remove solids including zirconium phosphate therefrom.

13. A solvent extraction process for the removal of thorium from raffinate effluent, the process comprising the following steps:

a. filtering the raffinate effluent to remove solids therefrom including zirconium phosphate;

b. passing the raffinate effluent filtrate at ambient temperature counter-currently with odourless kerosene through a contactor at a solvent to aqueous ratio of 1:10 as a pre-wash to remove organic contaminants;

c. passing the pre-washed raffinate counter-currently with 0.1M tri-n-octylphosphine oxide in odourless kerosene at a solvent to aqueous ratio adjusted to achieve a thorium loading in the loaded solvent therefrom not exceeding 4000 μg/ml;

d. back-washing the loaded solvent counter-currently with $4MK_2CO_3$ alkaline solution through a contactor at 60° C. at a solvent to aqueous ratio of 10:1;

e. subsequently diluting with 30% w/w water addition the alkaline back-wash solution to inhibit the formation of $KNO_3$ crystallization upon cooling thereof;

f. precipitating $Th(OH)_4$ from the diluted cooled alkaline backwash solution by adding a lime slurry at 10% w/w, and g. removing by filtration precipitated $Th(OH)_4$ precipitate.

* * * * *